US008783858B2

(12) United States Patent
Oizumi

(10) Patent No.: US 8,783,858 B2
(45) Date of Patent: Jul. 22, 2014

(54) RECORDING APPARATUS

(71) Applicant: Seiko Epson Corporation, Tokyo (JP)

(72) Inventor: Takao Oizumi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 13/650,880

(22) Filed: Oct. 12, 2012

(65) Prior Publication Data

US 2013/0093822 A1 Apr. 18, 2013

(30) Foreign Application Priority Data

Oct. 12, 2011 (JP) ..... 2011-224595
Aug. 10, 2012 (JP) ..... 2012-178143

(51) Int. Cl.
*B41J 2/01* (2006.01)

(52) U.S. Cl.
USPC ..... 347/104

(58) Field of Classification Search
USPC ..... 347/101, 104, 105, 106; 271/9.01, 9.02; 399/302, 308, 316
See application file for complete search history.

(56) References Cited

U.S. PATENT DOCUMENTS

| | | | | |
|---|---|---|---|---|
| 5,108,084 | A * | 4/1992 | Ishikawa et al. | 271/9.02 |
| 7,992,954 | B2 * | 8/2011 | Kawabata | 347/16 |
| 8,201,817 | B1 * | 6/2012 | Boo | 271/10.13 |
| 8,295,746 | B2 * | 10/2012 | Matsumoto | 399/302 |
| 2011/0049791 | A1 | 3/2011 | Osakabe | |

FOREIGN PATENT DOCUMENTS

| | | |
|---|---|---|
| JP | 2007-182316 | 7/2007 |
| JP | 2008-137729 | 6/2008 |
| JP | 2011-046497 | 10/2011 |

* cited by examiner

*Primary Examiner* — Anh T. N. Vo
(74) *Attorney, Agent, or Firm* — Workman Nydegger

(57) ABSTRACT

The recording apparatus includes a recording head that performs recording on paper which is fed along for manual bypass, a pair of feeding roller that is rotated in a forward direction and a reverse direction by drive force from a PF motor and feeds the paper to the recording head by the rotation in the forward direction, and a load applying mechanism that is placed at an upstream side further than the pair of feeding roller and gives load for suppressing the movement to the upstream side with respect to the paper, a leading end of which is returned to the upstream side by the rotation of the pair of feeding roller in the reverse direction, and a bending permission space that permits bending of the paper is interposed between the pair of feeding roller and the load applying mechanism.

12 Claims, 9 Drawing Sheets

RECORDING APPARATUS

BACKGROUND

1. Technical Field

The present invention relates to a recording apparatus including a recording head that records to a medium such as paper.

2. Related Art

In the related art, for example, a printer described in Japanese Patent No. 4640179 has been suggested as a recording apparatus that has a manual feeding path for feeding paper as an example of a medium by the manual bypass. The manual feeding path is a path from a manual sheet feed tray placed at the position furthest upstream in a feeding direction to a recording region where the recording is performed by the recording head. A pair of feeding roller having a pair of rollers, which is rotated by drive force from a motor, is provided in front (an upstream side in the feeding direction) of the recording region in the manual feeding path.

In a case of performing the recording processing on the paper that is fed by the manual bypass, the paper that is set on the manual sheet feed tray is fed by a user so that a leading end of the paper is moved along the manual feeding path. Moreover, when the leading end of the paper is detected by a paper edge sensor that is placed in front of the pair of paper feeding roller, the pair of feeding roller starts to be driven. Then, the paper is pinched by both rollers and is fed up to the recording region by the rotation of the both rollers. Moreover, the paper fed up to the recording region is recorded by the recording head.

In addition, between the pair of feeding roller and the manual sheet feed tray in the manual feeding path, a driving target portion (for example, a roller) has not been provided which is driven to convey the paper based on the drive force from a drive source such as a motor.

However, in a case of feeding the paper into the printer by the manual bypass, a so-called skewing may occur in which the paper is oblique to the feeding direction. The printer described in Japanese Patent No. 4640179 is not equipped with a mechanism which resolves the skew generated in the paper that is fed by the manual bypass. For that reason, the skewed paper is fed up to the recording region without the skew being resolved. Moreover, the skewed paper may be recorded, and thus the paper may be wastefully consumed.

SUMMARY

An advantage of some aspects of the invention is to provide a recording apparatus that is able to resolve the skew generated in the medium that is fed along the manual feeding path.

According to an aspect of the invention, there is provided a recording apparatus that includes a recording head that performs recording on a medium which is fed along a manual feeding path; a pair of feeding roller that is rotated in both of a forward direction and a reverse direction by drive force from a drive source and feeds the medium to the recording head side along the manual feeding path by the rotation in the forward direction; and a load applying unit that is placed at an upstream side further than the pair of feeding roller in the feeding direction of the medium along the manual feeding path, and gives a load for suppressing the movement to the upstream side in the feeding direction with respect to a medium in which a leading end thereof returns to the upstream side in the feeding direction by the rotation of the pair of feeding roller in the reverse direction, wherein a bending permission space, which permits the bending of the medium that is fed along the manual feeding path, is interposed between the pair of feeding roller and the load applying unit in the feeding direction.

According to the configuration, the medium which was fed from the upstream side to the downstream side along the manual feeding path by a user is pinched by the pair of feeding roller that is rotated in the forward direction. Then, the leading end of the medium is fed toward the recording region where the recording is performed by the recording head, by the rotation of the pair of feeding roller in the forward direction. When the pair of feeding roller begins to rotate in the reverse direction in this state, the leading end of the medium pinched by the pair of feeding roller returns to the upstream side in the feeding direction. As a result, the pinching of the medium due to the pair of feeding roller is resolved.

At this time, load for regulating the movement to the upstream side in the feeding direction is given to a portion (hereinafter, also referred to as an "abutment target portion") located at the upstream side in the feeding direction further than the leading end in the medium using the load applying unit. For that reason, the movement of a trailing end of the medium to the upstream side in the feeding direction is suppressed by the load applying unit. As a result, the medium is bent in the bending permission space that is located between the pair of feeding roller and the load applying unit in the feeding direction. In this state, the medium gives force of resolving the bending via the leading end thereof to the pair of feeding roller that is rotated in the reverse direction. As a result, even if a skewing is generated in the medium, the skew is gradually cancelled. Moreover, when the pair of feeding roller starts to rotate in the forward direction again after the skew is cancelled, the leading end of the medium is pinched by the pair of feeding roller again, and the medium is fed to the recording head side by the pair of feeding roller. As a result, recording is performed on the medium, in which the skew is cancelled, by the recording head.

In the recording apparatus of the invention, a mechanism, which gives drive force from a drive source to the medium that is fed along the manual feeding path, is not provided at the upstream side further than the pair of feeding roller in the feeding direction. Even in this configuration, by providing the load applying unit at the upstream side in the feeding direction further than the pair of feeding roller that is rotated in both of the forward and reverse directions by drive force from the drive source, it is possible to cancel the skew that is generated in the medium. Thus, it is possible to cancel the skew generated in the medium that is fed along the manual feeding path.

It is preferable that the recording apparatus of the invention may further include an automatic feeding device that feeds the medium held in a medium holding portion up to the pair of feeding roller along an automatic feeding path, the automatic feeding device is provided with a conveying roller that is rotated by the drive force from the drive source, and the conveying roller is located at a side that is opposite to the pair of feeding roller with the bending permission space interposed therebetween.

According to the configuration mentioned above, as the space which generates the bending of the medium that is fed along the manual feeding path, a bending permission space for generating the bending of the medium which is fed along the automatic feeding path is used. That is, it is possible to suppress an increase in size of the recording apparatus as much as the bending permission space is shared.

In the recording apparatus of the invention, the load applying unit may have an abutment member that abuts with the medium that is fed along the manual feeding path.

According to the configuration mentioned above, the abutment member gives frictional force to the medium that is fed along the manual feeding path. Such frictional force is given to the medium even when the pair of feeding roller rotates in the reverse direction so as to cancel the skew of the medium. Moreover, the movement of the trailing end of the medium to the upstream side in the feeding direction is suppressed by the frictional force that is generated between the abutment member and the abutment target portion of the medium. As a result, it is possible to bend the medium within the bending permission space by rotating the pair of feeding roller in the reverse direction, and, additionally, the skew of the medium can be resolved.

In the recording apparatus of the invention, at least a portion of the path of the upstream side in the feeding direction further than the pair of feeding roller in the manual feeding path may be a meandering path that meanders to include a component of a direction perpendicular to a recording target surface of the medium that is fed along the manual feeding path, and the load applying unit may have a guidance portion for guiding the medium along the meandering path.

According to the configuration mentioned above, load for suppressing the movement to the upstream side in the feeding direction is given to a portion (an abutment target portion) passing through the meandering path in the medium, by the guidance portion. As a result, it is possible to bend the medium within the bending permission space by rotating the pair of feeding roller that interposes the medium in the reverse direction. Thus, it is possible to cancel the skew of the medium.

According to another aspect of the invention, there is provided a recording apparatus that includes a recording head that records a medium which is fed along a manual feeding path; a pair of feeding roller that is rotated in a forward direction and a reverse direction by drive force from a drive source and feeds the medium to the recording head side along the manual feeding path by the rotation in the forward direction; and load applying unit that is placed at an upstream side further than the pair of feeding roller in the feeding direction of the medium along the manual feeding path and gives load for suppressing the movement to the upstream side in the feeding direction with respect to a medium in which a leading end thereof abuts with the upstream side in the feeding direction of the pair of feeding roller that is rotated in the reverse direction, wherein a bending permission space, which permits the bending of the medium that is fed along the manual feeding path, is interposed between the pair of feeding roller and the load applying unit in the feeding direction.

According to the configuration mentioned above, the leading end of the medium, which was fed from the upstream side toward the downstream side along the manual feeding path by a user, abuts with the upstream side in the feeding direction of the pair of feeding roller that is rotated in the reverse direction. At this time, load for regulating the movement to the upstream side in the feeding direction is given to a portion located at the upstream side in the feeding direction further than the leading end in the medium using the load applying unit. For that reason, the movement of the trailing end of the medium to the upstream side in the feeding direction is suppressed by the load applying unit. As a result, the medium is bent in the bending permission space that is located between the pair of feeding roller and the load applying unit in the feeding direction. In this state, the medium gives force of resolving the bending via the leading end thereof to the pair of feeding roller that is rotated in the reverse direction. As a result, even if a skew is generated in the medium, the skew is gradually cancelled. Moreover, when the pair of feeding roller starts to rotate in the forward direction again after the skew is cancelled, the leading end of the medium is pinched by the pair of feeding roller again, and the medium is fed to the recording head side by the pair of feeding roller. As a result, on the medium, in which the skew is cancelled, recording is performed by the recording head.

It is preferable that the recording apparatus of the invention may further include an automatic feeding device that feeds the medium held in the medium holding portion up to the pair of feeding roller along the automatic feeding path, the automatic feeding device is provided with a conveying roller that is rotated by the drive force from the drive source, and the conveying roller is located at a side that is opposite to the pair of feeding roller with the bending permission space interposed therebetween.

According to the configuration mentioned above, as the space which generates the bending of the medium that is fed along the manual feeding path, a bending permission space for generating the bending of the medium which is fed along the automatic feeding path is used. That is, it is possible to suppress an increase in size of the recording apparatus, therefore the bending permission space is shared.

According to still another aspect of the invention, there is provided a recording apparatus that includes a recording head that records a first medium and a second medium which are fed along a manual feeding path; a pair of feeding roller that is rotated in both of a forward direction and a reverse direction by drive force from a drive source and feeds the first medium and the second medium to the recording head side along the manual feeding path by the rotation in the forward direction; and a load applying unit that is placed at an upstream side further than the pair of feeding roller in the feeding direction of the medium along the manual feeding path, and gives load for suppressing the movement to the upstream side in the feeding direction, with respect to the first medium which is pinched by the pair of feeding roller rotating in the forward direction, a leading end of which is moved to the downstream side in the feeding direction, then is pinched by the pair of feeding roller rotating in the reverse direction, and returns to the upstream side in the feeding direction, and the second medium, a leading end of which abuts with the upstream side in the feeding direction of the pair of feeding roller rotating in the reverse direction, wherein a bending permission space, which permits the bending of the first medium and the second medium that are fed along the manual feeding path, is interposed between the pair of feeding roller and the load applying unit in the feeding direction.

According to the configuration mentioned above, when feeding the first medium and the second medium along the manual feeding path, the load applying unit suppresses the movement to the upstream side in the feeding direction, with respect to the first medium which is pinched by the pair of feeding roller rotating in the forward direction, the leading end of which is moved to the downstream side in the feeding direction, then is pinched by the pair of feeding roller rotating in the reverse direction, and returns to the upstream side in the feeding direction, and the second medium, the leading end of which abuts with the upstream side in the feeding direction of the pair of feeding roller rotating in the reverse direction. Thus, since it is possible to select a magnitude of the bending of the first medium and the second medium by the first medium and the second medium having thickness, rigidities or the like different from each other, and set the bending of the second medium to be smaller than the bending of the first medium, it is possible to suppress the damage of the second medium.

It is preferable that the recording apparatus of the invention may further include an automatic feeding device that feeds the medium held in the medium holding portion up to the pair of feeding roller along the automatic feeding path, the automatic feeding device is provided with a conveying roller that is rotated by the drive force from the drive source, and the conveying roller is located at a side that is opposite to the pair of feeding roller with the bending permission space interposed therebetween.

According to the configuration mentioned above, as the space which generates the bending of the medium that is fed along the manual feeding path, a bending permission space for generating the bending of the medium which is fed along the automatic feeding path is used. That is, it is possible to suppress an increase in size of the recording apparatus as much as the bending permission space is shared.

In the recording apparatus of the invention, the conveying roller may suppress the movement to the upstream side in the feeding direction by stopping the rotation, with respect to the first medium which is pinched by the pair of feeding roller rotating in the forward direction, a leading end of which is moved to the downstream side in the feeding direction, then is pinched by the pair of feeding roller rotating in the reverse direction, and returns to the upstream side in the feeding direction, and the second medium, a leading end of which abuts with the upstream side in the feeding direction of the pair of feeding roller rotating in the reverse direction.

According to the configuration mentioned above, when feeding the first medium and the second medium along the automatic feeding path, the conveying roller regulates the movement to the upstream side in the feeding direction by stopping the rotation, with respect to the first medium which is pinched by the pair of feeding roller rotating in the forward direction, the leading end of which is moved to the downstream side in the feeding direction, then is pinched by the pair of feeding roller rotating in the reverse direction, and returns to the upstream side in the feeding direction, and the second medium, the leading end of which abuts with the upstream side in the feeding direction of the pair of feeding roller rotating in the reverse direction. Thus, since it is possible to select a magnitude of the bending of the first medium and the second medium by the first medium and the second medium having thickness, rigidities or the like different from each other and set the bending of the second medium to be smaller than the bending of the first medium, it is possible to suppress the damage of the second medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail based on FIGS. 1 to 8. In addition, a left side in FIG. 1 is referred to as a "front side", and a right side in FIG. 1 is referred to as a "back side".

Figure 1:
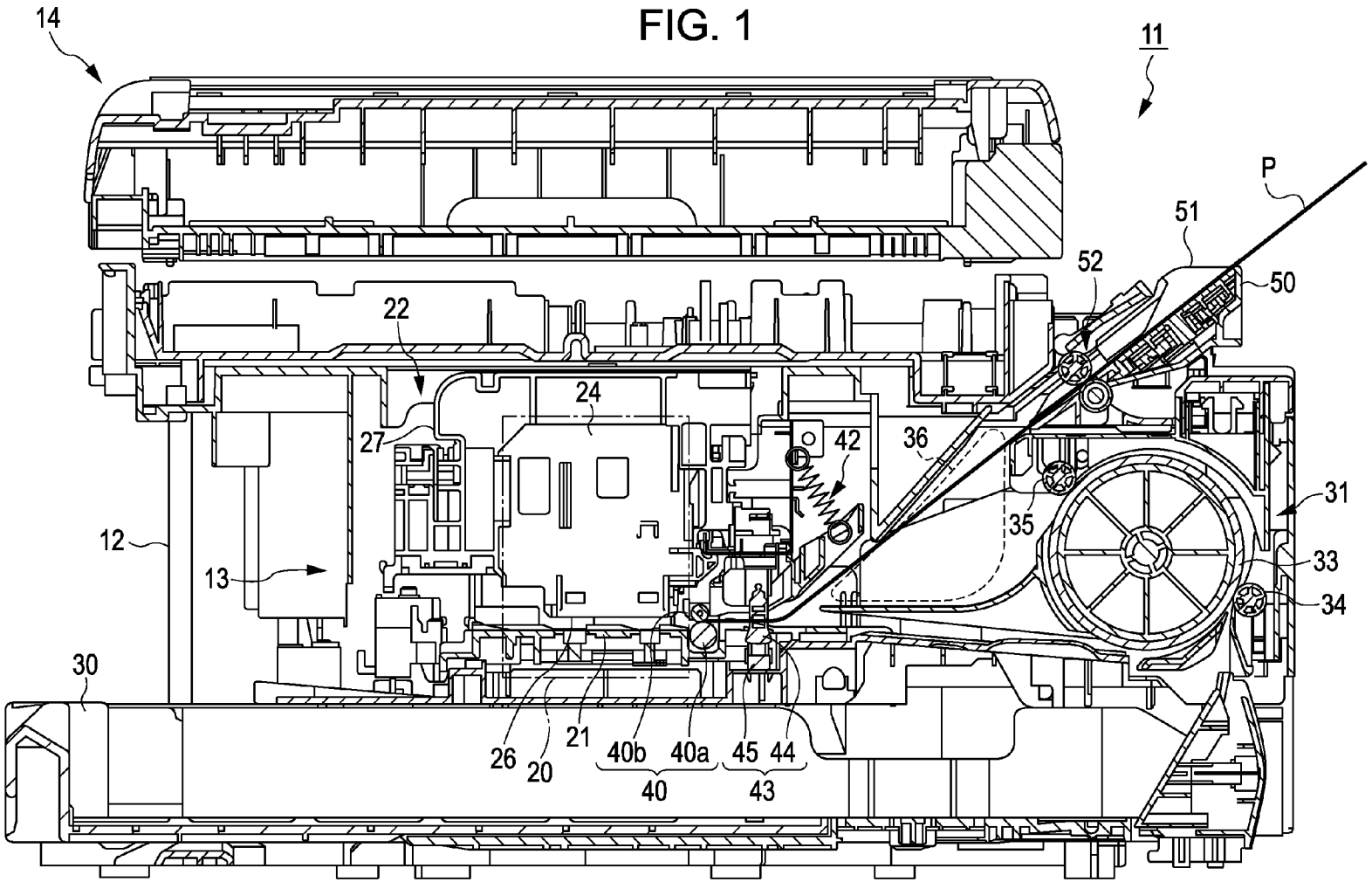
FIG. 1 is a side cross-sectional view that illustrates an embodiment of a multi-function printer relating to a recording apparatus of the invention.

As shown in FIG. 1, a multi-function printer 11 as an example of the recording apparatus includes a recording portion 13 that is placed in an apparatus main body 12 and performs the recording processing on paper P as an example of a medium, and an image reading portion 14 that is placed over the recording portion 13 in FIG. 1. The image reading portion 14 performs the reading of the image recorded on a reading target medium (for example, paper) that is set on the image reading portion 14.

Next, the recording portion 13 will be described with reference to FIGS. 1 to 3.

Figure 2:
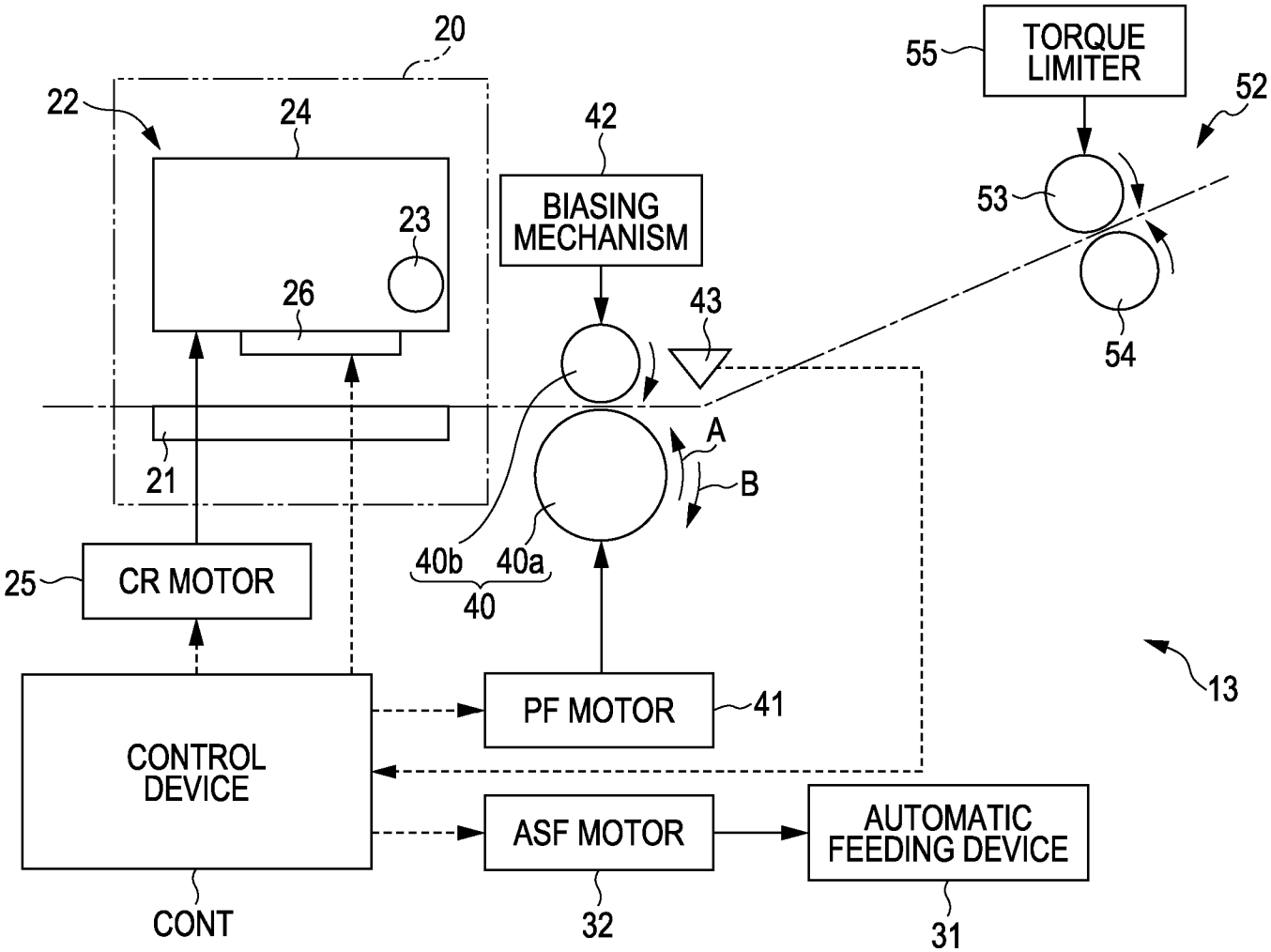
FIG. 2 is a block diagram that illustrates a schematic configuration of a recording portion.

As shown in FIGS. 1 and 2, the recording portion 13 of the present embodiment is an ink jet type printer, and has automatic feeding path and a manual feeding path. In a recording region 20 where paper P is fed conveyed from the respective feeding paths in the recording portion 13, a support table 21 which supports the fed paper P, and a recording mechanism 22, which is located at a side that is opposite to the support table 21 with the paper P interposed therebetween, are provided. The recording mechanism 22 includes a guide shaft 23 that is extended in a scanning direction (a direction perpendicular to a paper space in FIGS. 1 and 2), and a carriage 24 that is supported by the guide shaft 23. Drive force from a CR motor 25 is transmitted to the carriage 24 via a power transmission mechanism (not shown), and thus the carriage 24 advances and retreats in the scanning direction while being guided by the guide shaft 23.

A recording head 26 for recording the paper P supported by the support table 21 is mounted on a portion (a lower portion in FIG. 1) of the carriage 24 facing the support table 21. The recording head 26 records the paper P by ejecting ink as an example of a recording material that is supplied from an ink cartridge 27 mounted on the carriage 24.

Furthermore, a paper feeding cassette 30 as an example of a medium holding portion, which holds a plurality of sheets of papers P in a stacked state, is provided in a lower portion in FIG. 1 of the recording region 20 in the apparatus main body 12. The paper feeding cassette 30 can be attached to and detached from the front side thereof with respect to the apparatus main body 12. Moreover, the papers P are fed from the paper feeding cassette 30 using the automatic feeding device 31 one by one along the automatic feeding path faces from an upstream side (the paper feeding cassette 30 side) to a downstream side (the recording region 20 side).

The automatic feeding device 31 includes a sending mechanism (not shown) for sending the uppermost paper of the papers P held in the paper feeding cassette 30 to the outside (the right oblique upper part in FIG. 1) of the paper feeding cassette 30. Moreover, a middle roller 33 as a conveying roller, to which drive force is transmitted from an ASF motor 32 as an example of a drive source, is provided at the downstream side of the sending mechanism in the automatic feeding path.

A retard roller 34 and an assist roller 35 subjected to the following rotation based on the rotation of the middle roller 33 are provided near the middle roller 33. In the retard roller 34 and the assist roller 35, the retard roller 34 located at the upstream side in the feeding direction pinches the paper P sent from the paper feeding cassette 30 together with the middle roller 33, and feeds the paper P to the downstream side in the feeding direction. Furthermore, the assist roller 35 pinches the paper P sent from the middle roller 33 and the retard roller 34 together with the middle roller 33, and feeds the paper forward. Furthermore, a length of the assist roller 35 in a width direction of the paper P is short, and the assist roller 35 is placed in the center of the middle roller 33 in the width direction of the paper P.

Figure 3:
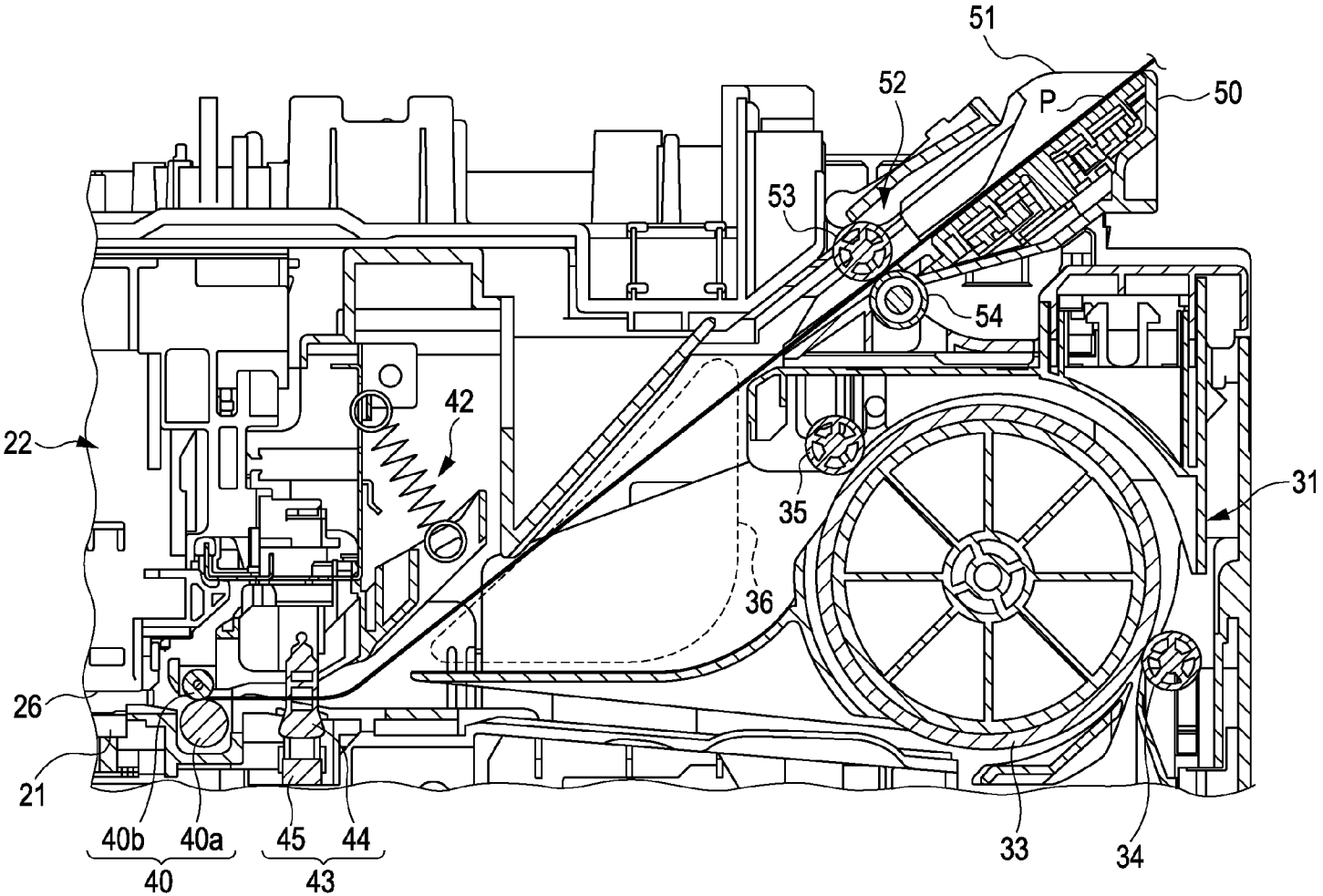
FIG. 3 is an enlarged view of main portions of the recording portion.

Furthermore, as shown in FIGS. 2 and 3, at the downstream side in the feeding direction further than the middle roller 33, that is, at the front side of the middle roller 33, a pair of feeding roller 40 is provided in the state of going through a bending permission space 36 for bending the paper P that is sent along the convey for automatic feeding path. The pair of feeding roller 40 has a pair of feeding rollers 40*a* and 40*b* that is placed to pinch the paper P. One roller of the respective feeding rollers is a driving roller 40*a* to which drive force is transmitted from a PF motor 41 as an example of the drive source, and the other roller thereof is a following roller 40*b* that is subjected to the following rotation based on the rotation of the driving roller 40*a*. The respective feeding rollers 40*a* and 40*b* are rotated in a forward direction A when feeding the paper P to the recording region 20, and are rotated in a reverse direction B when returning the paper P to the upstream side in the feeding direction.

Furthermore, a biasing mechanism 42, which applies biasing force in a direction of approaching the driving roller 40*a* to the following roller 40*b*, is provided above the pair of feeding roller 40 in FIG. 3. Thus, even when various papers P having a thickness different from each other are fed, the respective feeding rollers 40*a* and 40*b* are able to pinch the papers P using a suitable holding force.

Furthermore, a paper detection mechanism 43 for detecting the leading end of the fed paper P is provided at the back side (the right side in FIG. 3) of the pair of feeding roller 40 in the feeding direction. The paper detection mechanism 43 includes a sensor lever 44 that can be rotated around a rotation axis (not shown) extended in the same direction as the scanning direction of the carriage 24, and a paper detection sensor 45 that is placed below the sensor lever 44 in FIG. 3. The sensor lever 44 is rotated by being pushed by the leading end of the paper P. Moreover, the paper detection sensor 45 detects that the leading end of the paper P passes by detecting the rotation of the sensor lever 44, and outputs the detection signal of the meaning of the detection to a control device CONT as an example of a control unit.

Next, a configuration for feeding the paper along the manual feeding path will be described with reference to FIGS. 2 and 3.

As shown in FIGS. 2 and 3, a manual sheet feed tray 50 is provided at the uppermost upstream side in the manual feeding path. The manual sheet feed tray 50 is provided with a pair of edge guides 51 placed at both sides in the width direction of the paper P that is set on the manual sheet feed tray 50. In the present embodiment, the manual sheet feed tray 50 is placed at a position that is right above the middle roller 33 in FIG. 1 and the back side of the image reading portion 14.

Moreover, as shown by a dot and dash line in FIG. 2, the manual feeding path is extended from the manual sheet feed tray 50 to the back side of the paper detection mechanism 43 toward the left oblique downside in FIG. 3 and then is horizontally extended. That is, the manual feeding path of the present embodiment passes through the upper portion of the bending permission space 36, and then is joined in an automatic feeding path. For that reason, in the present embodiment, it is possible to bend the paper P that is fed along the manual feeding path in the bending permission space 36.

At the downstream side of the manual sheet feed tray 50 in the manual feeding path, a load applying mechanism 52 is provided as an example of the load applying unit to which drive force is not transmitted from a drive source such as a PF motor 41, and an ASF motor 32. The load applying mechanism 52 is provided with a load roller 53 as an example of an abutment member, a roll roller 54 that is placed to pinch the paper P together with the load roller 53, and a biasing member (not shown) that applies the biasing force in a direction of approaching the load roller 53 to the roll roller 54. Lengths of the load roller 53 and the roll roller 54 in the width direction of the paper P are short, and the load roller 53 and the roll roller 54 are each placed in the center in the width direction of the paper P that is fed along the manual feeding path. Furthermore, the load roller 53 and the roll roller 54 can be rotated around a rotation axis (not shown) placed at the center in the forward and reverse direction. In addition, the rotation direction (an arrow direction in FIG. 2) of the load roller 53 and the roll roller 54 when feeding the paper P set on the manual sheet feed tray 50 to the downstream side in the feeding direction is the forward direction.

Furthermore, the load applying mechanism 52 is provided with a torque limiter 55 as an example of a regulating mechanism that gives force for regulating the rotation of the load roller 53 in the reverse direction (a direction opposite to the arrow direction of FIG. 2) to the load roller 53. Moreover, if force (hereinafter, also referred to as "inversion force") for rotating the load roller in the reverse direction is less than a predetermined force, the rotation of the load roller 53 in the reverse direction is regulated by the torque limiter 55. Meanwhile, if inversion force equal to or greater than the predetermined force is transmitted to the load roller 53, the torque limiter 55 permits the rotation of the load roller 53 in the reverse direction. In addition, the torque limiter 55 does not regulate the rotation of the load roller 53 in the forward direction.

Next, an operation of the recording portion 13 when feeding the paper P along the automatic feeding path will be described.

Incidentally, when feeding the paper P that is held by the paper feeding cassette 30, the sending mechanism and the middle roller 33 are driven. Then, the uppermost paper P in the paper feeding cassette 30 is fed from the upstream side toward the downstream side along the automatic feeding path. When the leading end of the paper P comes into contact with the sensor lever 44 and the sensor lever 44 is rotated, the leading end of the paper P is detected by the paper detection sensor 45. Then, the respective feeding rollers 40*a* and 40*b* constituting the pair of feeding roller 40 start to rotate in the forward direction A, and the paper P leads to the recording region 20 side in the state of being pinched by the respective feeding rollers 40*a* and 40*b*.

In this state, a skew may occur in the paper P. For that reason, in order to cancel the skew, the rotation of the middle roller 33 is stopped. Then, the middle roller 33 is difficult to rotate either in the forward direction or in the reverse direction. As a result, the movement of a portion (hereinafter, also referred to as a "pinched portion") pinched by the middle roller 33 and the assist roller 35 in the paper P is regulated by the middle roller 33 and the assist roller 35.

Furthermore, when the rotation of the middle roller 33 is regulated, the respective feeding rollers 40*a* and 40*b* start to rotate in the reverse direction B. Then, the leading end of the paper P returns to the upstream side in the feeding direction. As a result, the pinching of the paper P due to the respective feeding rollers 40*a* and 40*b* is cancelled. In this state, the movement of the paper P itself to the upstream side in the feeding direction is regulated by the middle roller 33 and the assist roller 35. For that reason, the portion of the leading end side further than the pinched portion in the paper P is bent in the bending permission space 36. Then, the leading end of the paper P coming into contact with the respective feeding rollers 40*a* and 40*b* rotating in the reverse direction B gives repulsive force of resolving the bending of the paper P to the respective feeding rollers 40*a* and 40*b*. As a result, the skew of the leading end of the paper P is gradually cancelled.

Moreover, at the timing when the skew of the leading end of the paper P is cancelled, the respective feeding rollers 40*a* and 40*b* start to rotate in the forward direction A again, and the rotation of the middle roller 33 restarts. Then, the paper P leads to the recording region 20 in the state where the skew is cancelled. Moreover, the paper P is recorded by the driving of the recording mechanism 22, and is finally discharged to the outside of the recording portion 13.

Next, an operation of the recording portion 13 when feeding the paper P along the manual feeding path will be described with reference to FIGS. 4 to 7.

Figure 4:
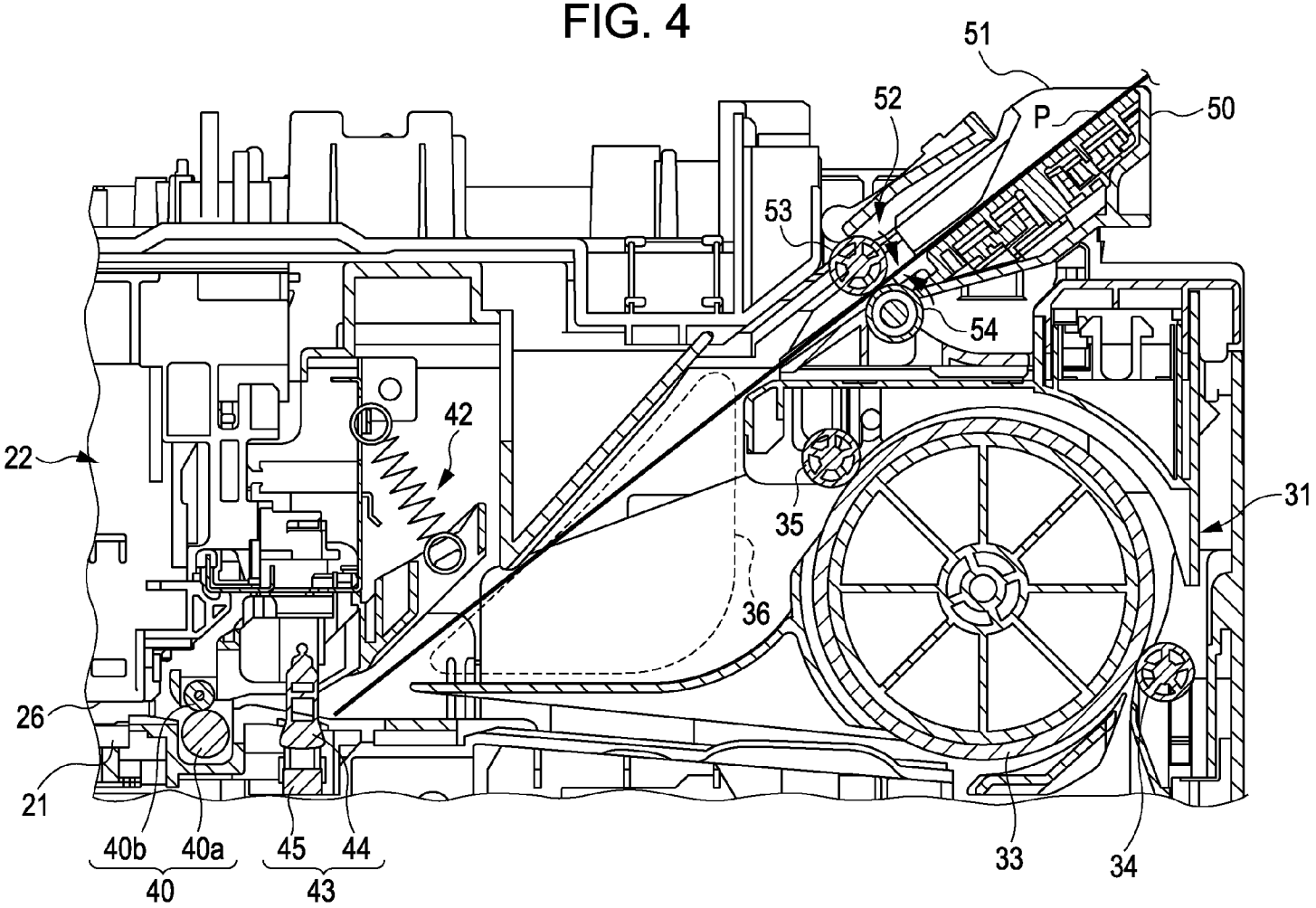
FIG. 4 is an operation diagram that describes an operation for resolving a skew of paper.

Incidentally, while the paper P set on the manual sheet feed tray 50 is fed along the manual feeding path, as shown in FIG. 4, the paper P is pinched by the load roller 53 and the roll roller 54. At this time, since the load roller 53 is rotated in the forward direction, the torque limiter 55 does not regulate the rotation of the load roller 53. For that reason, a user who feeds the paper P pushes the paper P so that the paper P is fed along the manual feeding path without feeling much catching by the paper P being pinched by the load roller 53 and the roll roller 54.

Figure 5:
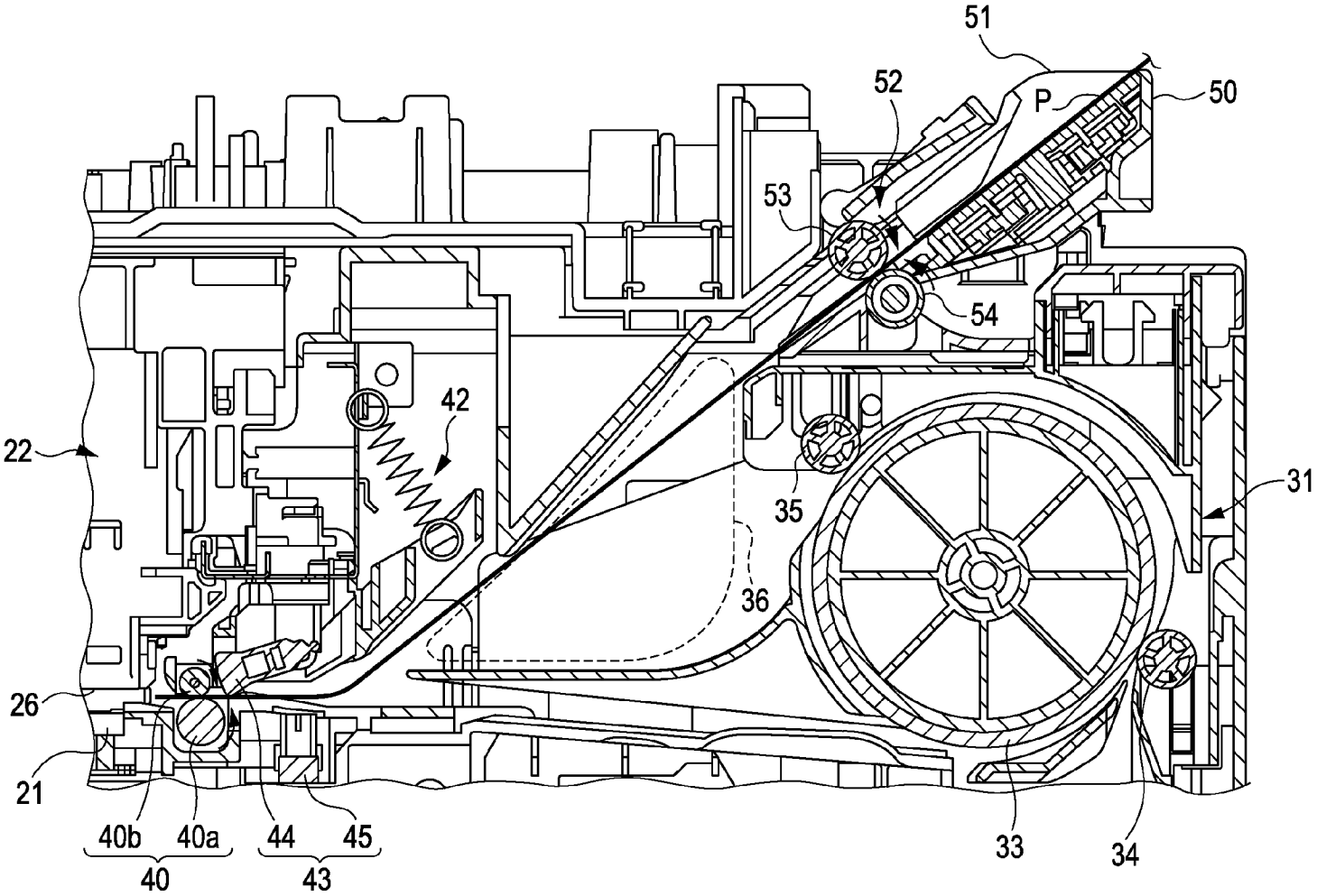
FIG. 5 is an operation diagram that describes an operation for resolving a skew of paper.

Moreover, as shown in FIG. 5, when the leading end of the paper P comes into contact with the sensor lever 44, the sensor lever 44 is rotated. Then, the leading end of the paper P is detected by the paper detection sensor 45, and the respective feeding rollers 40*a* and 40*b* start to rotate in the forward direction A. Then, the paper P leads to the recording region 20 side in the state of being pinched by the respective feeding rollers 40*a* and 40*b*.

Figure 6:
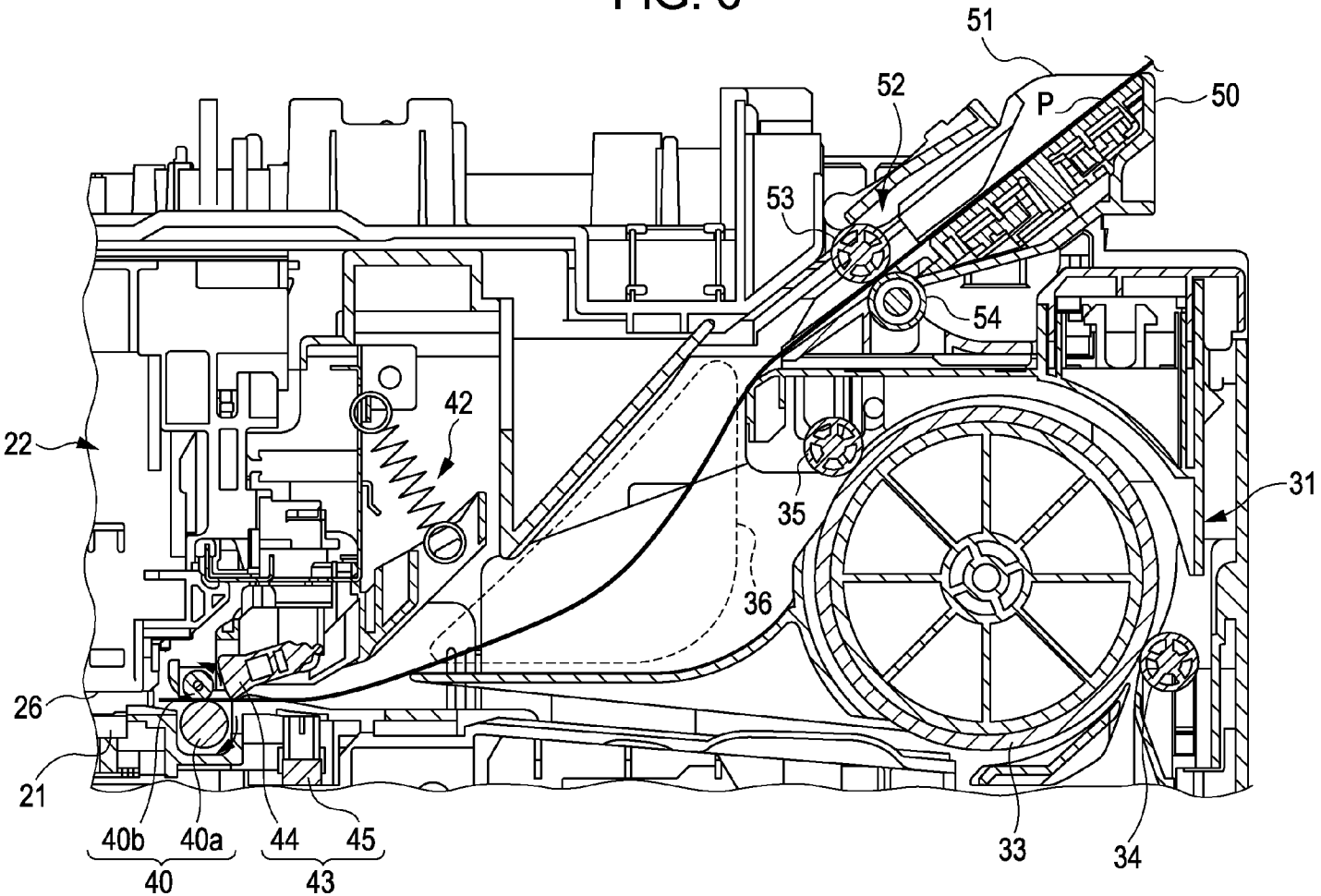
FIG. 6 is an operation diagram that describes an operation for resolving a skew of paper.

In this state, the skew may occur in the paper P. For that reason, as shown in FIG. 6, in order to cancel the skew, the respective feeding rollers 40*a* and 40*b* start to rotate in the reverse direction B side. Then, the leading end of the paper P returns to the upstream side in the feeding direction. As a result, the pinching of the paper P due to the respective feeding rollers 40*a* and 40*b* is cancelled. At this time, force for rotating the load rollers 53 in the reverse direction, that is, inversion force is applied to the load roller 53 that pinches the paper P together with the roll roller 54. However, since the inversion force is less than the predetermined force, the rotation of the load roller 53 in the reverse direction is regulated by the torque limiter 55. As a result, the paper P is regulated from returning to the upstream side in the feeding direction.

Figure 7:
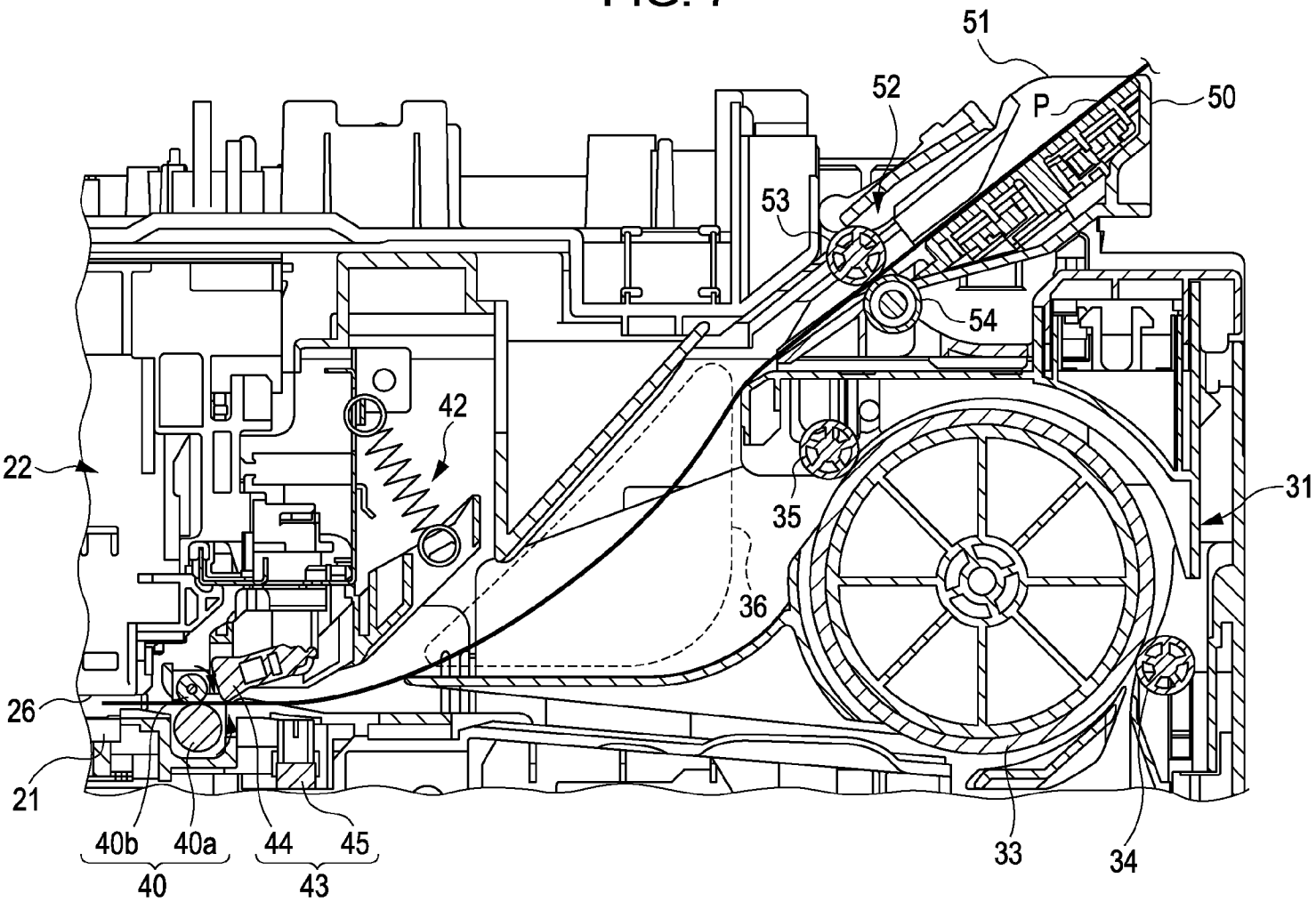
FIG. 7 is an operation diagram that describes an operation for resolving a skew of paper.

Then, a portion of the leading end side further than the portion pinched by the load roller and the roll roller 54 in the paper P is bent in the bending permission space 36. Moreover, the leading end of the paper P coming into contact with the respective feeding rollers 40*a* and 40*b* rotating in the reverse direction B gives the repulsive force of resolving the bending of the paper P to the respective feeding rollers 40*a* and 40*b*. As a result, the skew of the leading end of the paper P is gradually cancelled. Moreover, as shown in FIG. 7, at the timing when the skew of the leading end of the paper P is cancelled, when the respective feeding rollers 40*a* and 40*b* start to rotate in the forward direction A again, the paper P leads to the recording region 20 in the state where the skew is cancelled. Moreover, the paper P is recorded by the driving of the recording mechanism 22, and finally is discharged to the outside of the recording portion 13. As a result, recording errors to the paper P due to the occurrence of skew are suppressed.

Figure 8:
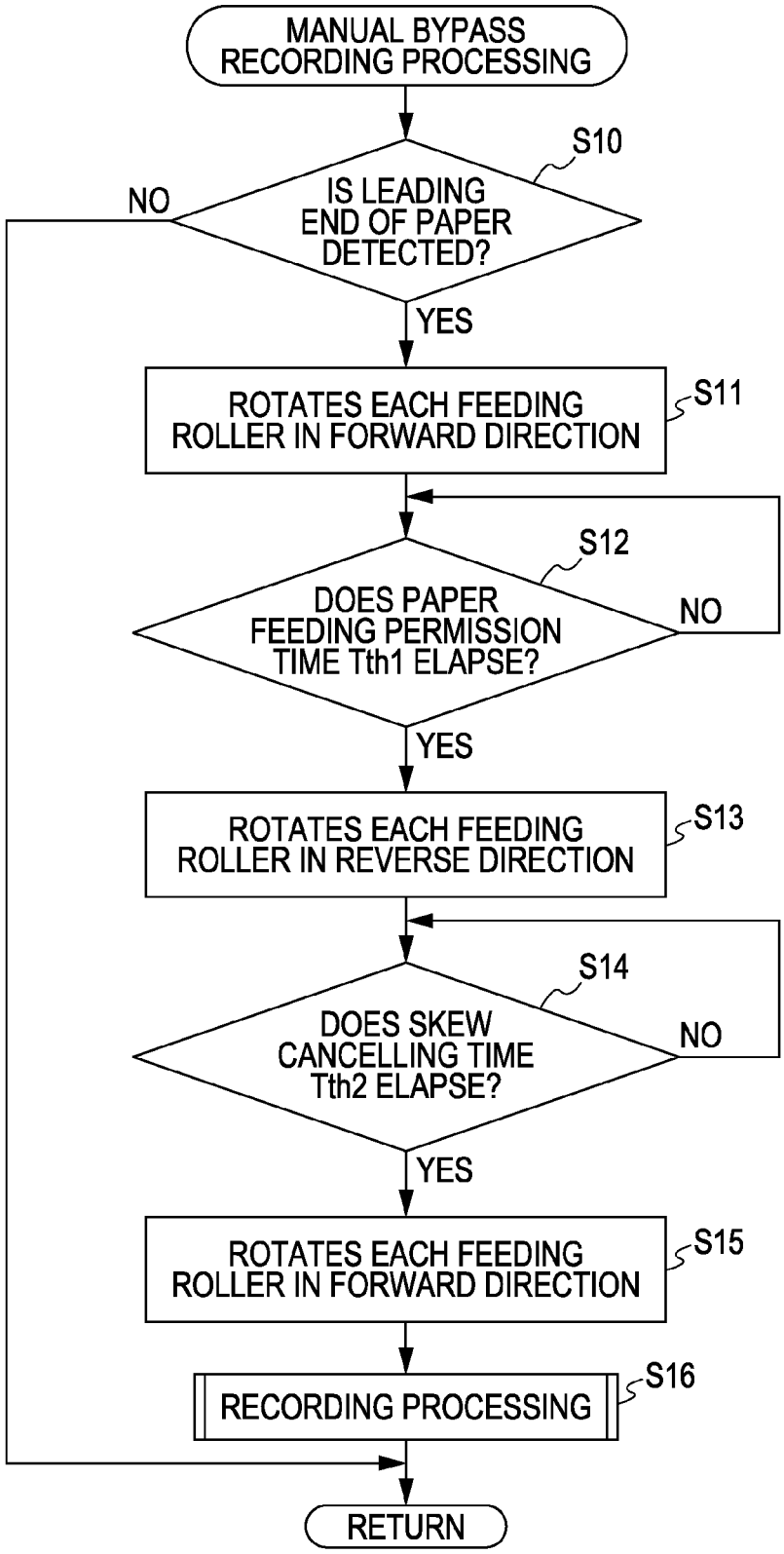
FIG. 8 is a flow chart that illustrates a manual bypass recording processing routine.

Next, a manual bypass recording processing routine executed by the control device CONT when the paper P is fed by the manual bypass will be described with reference to a flow chart shown in FIG. 8. In addition, the manual bypass recording processing routine is a processing routine that is executed when being set in a manual bypass recording (printing) mode.

Incidentally, in the manual bypass recording processing routine, the control device CONT determines whether or not the leading end of the paper P can be detected using the paper detection sensor 45 (step S10). When the leading end of the paper P is not detected (step S10: NO), the control device CONT finishes the manual bypass recording processing routine once. Meanwhile, when the leading end of the paper P can be detected (step S10: YES), the control device CONT drives the PF motor 41 so as to rotate the respective feeding rollers 40*a* and 40*b* that constitute the pair of feeding roller 40, in the forward direction A (step S11). Next, the control device CONT determines whether or not the elapsed time after the PF motor 41 starts to be driven passes a predetermined paper feeding permission time Tth1 (step S12). In addition, the paper feeding permission time Tth1 may be changed depending on the type of the medium that is fed by the manual bypass.

When the elapsed time does not pass the paper feeding permission time Tth1 (step S12: NO), the control device CONT repeatedly performs the determination processing of step S12 until the elapsed time passes the paper feeding permission time Tth1. Meanwhile, when the elapsed time passes the paper feeding permission time Tth1 (step S12: YES), the control device CONT drives the PF motor 41 so as to rotate the respective feeding rollers 40*a* and 40*b* in the reverse direction B (step S13).

Next, the control device CONT determines whether or not the elapsed time, after the rotation of the respective feeding rollers 40*a* and 40*b* in the reverse direction B starts, passes a predetermined skew resolving time Tth2 (step S14). The skew resolving time Tth2 is set at the time that is longer than the paper feeding permission time Tth1. When the elapsed time does not pass the skew resolving time Tth2 (step S14: NO), the control device CONT repeatedly performs the determination processing of step S14 until the elapsed time passes the skew resolving time Tth2. Meanwhile, when the elapsed time passes the skew resolving time Tth2 (Step S14: YES), the control device CONT drives the PF motor 41 so as to rotate the respective feeding rollers 40*a* and 40*b* in the forward direction A (step S15). Moreover, the control device CONT performs the recording processing for recording the paper P (step S16). Moreover, when the recorded paper P is discharged, the control device CONT finishes the manual bypass recording processing routine once.

Although the method of resolving the skew mentioned above is a method of moving the leading end of the paper P to the downstream side in the feeding direction in the state of being pinched by the pair of feeding roller 40, and then returning the leading end to the upstream side in the feeding direction, it may be possible to adopt a method of bringing the leading end of the paper P into contact with the upstream side in the feeding direction of the pair of feeding roller 40 rotating in the reverse direction.

Firstly, the method of bringing the leading end of the paper P into contact with the upstream side in the feeding direction of the pair of feeding roller 40 rotating in the reverse direction when feeding the paper P along the automatic feeding path to cancel the skew will be described. By the driving of the sending mechanism and the middle roller 33, the uppermost paper P in the paper feeding cassette 30 is fed from the upstream side to the downstream side along the automatic feeding path.

When the leading end of the fed paper P comes into contact with the sensor lever 44 and the sensor lever 44 is rotated, the leading end of the paper P is detected by the paper detection sensor 45. Then, the respective feeding rollers 40*a* and 40*b* constituting the pair of feeding roller 40 start to rotate in the reverse direction.

The leading end of the paper P, which is fed to the downstream side in the feeding direction by the rotation of the middle roller 33, comes into contact with the upstream side in the feeding direction of the pair of feeding roller 40 rotating in the reverse direction. Moreover, the rotation of the middle roller 33 is stopped. Then, the middle roller 33 is difficult to rotate either in the forward direction or in the reverse direction. As a result, the movement of the pinched portion in the paper P due to the middle roller 33 and the assist roller 35 is regulated by the middle roller 33 and the assist roller 35.

In this state, the leading end of the paper P comes into contact with the upstream side in the feeding direction of the respective feeding rollers 40*a* and 40*b*, and the movement to the upstream side in the feeding direction of the paper P itself is regulated by the middle roller 33 and the assist roller 35. For that reason, the portion of the leading end side further than the pinched portion in the paper P is bent in the bending permission space 36. Then, the leading end of the paper P coming into contact with the respective feeding rollers 40*a* and 40*b* rotating in the reverse direction applies repulsive force of resolving the bending of the paper P to the respective feeding rollers 40*a* and 40*b*. As a result, the skew of the leading end of the paper P is gradually cancelled.

Next, a method of bringing the leading end of the paper P into contact with the upstream side in the feeding direct of the pair of feeding roller 40 rotating in the reverse direction when feeding the paper P along the manual feeding path to cancel the skew will be described. A user pushes the paper P so that the paper P is fed along the manual feeding path.

When the leading end of the fed paper P comes into contact with the sensor lever 44 and the sensor lever 44 is rotated, the leading end of the paper P is detected by the paper detection sensor 45. Then, the respective feeding rollers 40*a* and 40*b* constituting the pair of feeding roller 40 start to rotate in the reverse direction.

In this state, the leading end of the paper P comes into contact with the upstream side in the feeding direction of the respective feeding rollers 40*a* and 40*b*, and force for rotating the load roller 53 in the reverse direction, that is, inversion force is applied to the load roller 53 that pinches the paper P together with the roll roller 54. However, since the inversion force is less than the predetermined force, the rotation of the load roller 53 in the reverse direction is regulated by the torque limiter 55. As a result, the paper P is regulated from being returned to the upstream side in the feeding direction.

Then, the portion of the leading end side further than the portion pinched by the load roller and the roll roller 54 in the paper P is bent in the bending permission space 36. Moreover, the leading end of the paper P coming into contact with the respective feeding rollers 40*a* and 40*b* rotating in the reverse direction applies repulsive force of resolving the bending of the paper P to the respective feeding rollers 40*a* and 40*b*. As a result, the skew of the leading end of the paper P is gradually cancelled.

Next, the selection of the method of resolving the skew by the recording medium with rigidities different from each other will be described. A normal paper or the like with relatively small rigidity is referred to as a first medium. Specialized photographic paper, an envelope or the like with relatively great rigidity is referred to as a second medium.

When feeding the first medium along the automatic feeding path, a method is used which moves the leading end of the first medium to the downstream side in the feeding direction in the state of being pinched by the pair of feeding roller 40 rotating in the forward direction, and then, returns the leading end to the upstream side in the feeding direction in the state of being pinched by the pair of feeding roller 40 rotating in the reverse direction is used. When feeding the second medium along the automatic feeding path, a method is used which brings the leading end of the second medium into contact with the upstream side in the feeding direction of the pair of feeding roller 40 that rotates in the reverse direction. As a result, the bending of the second medium is smaller than that of the first medium in the bending permission space.

Similarly, when feeding the first medium along the manual feeding path, a method is used which moves the leading end of the first medium to the downstream side in the feeding direction in the state of being pinched by the pair of feeding roller 40 rotating in the forward direction, and then, returns the leading end to the upstream side in the feeding direction rotating in the reverse direction. Furthermore, when feeding the second medium along the manual feeding path, a method is used which brings the leading end of the second medium into contact with the upstream side in the feeding direction of the pair of feeding roller 40 rotating in the reverse direction. As a result, the bending of the second medium is smaller than that of the first medium in the bending permission space. Furthermore, even when rigidity is identical, the method may be adopted depending on the thickness.

In this manner, it is possible to select the magnitude of the bending of the first medium and the second medium by the first medium and the second medium with thicknesses, rigidities or the like different from each other. That is, since the bending of the second medium can be set to be smaller than that of the first medium, it is possible to suppress the second medium from being damaged.

In the recording portion 13 in the present embodiment, although the manual feeding path and the automatic feeding path are joined with each other at the downstream side in the feeding direction of the load roller 53 and at the downstream side in the feeding direction of the assist roller 35, a configuration may be adopted in which the assist roller 35 is not included, the load roller 53 provided with the torque limiter 55 is brought into contact with the upper portion of the middle roller 33 in a followable manner, and the manual feeding path and the automatic feeding path are jointed with each other at the nip position between the load roller 53 and the middle roller 33. That is, a configuration may be adopted in which the paper P mounted on the manual sheet feed tray 50 is pinched by the load roller 53 and the middle roller 33 and is fed to the downstream side in the feeding direction, and the paper P mounted on the paper feeding cassette 30 is pinched by the load roller 53 and the middle roller 33 and is fed to the downstream side in the feeding direction.

According to the embodiment mentioned above, the following effects can be provided:

(1) By providing the load applying mechanism 52 in the manual feeding path, it is possible to cancel the skew of the paper P that is fed by the manual bypass, in the same method as the skew resolving method of the paper P in the automatic feeding device 31. As a result, it is possible to suppress an occurrence of recording errors in the paper P that is fed by the manual bypass.

(2) In addition, the space causing the paper that is fed by the manual bypass to be bent is the bending permission space 36 for bending the paper P that is fed along the automatic feeding path. For that reason, it is possible to suppress an increase in size of the entire apparatus, compared to a case where the bending permission space for manual bypass is provided at a position different from the bending permission space 36.

(3) The rotation of the load roller 53 in the forward direction is not regulated by the torque limiter 55. For that reason, a user is able to set the leading end of the paper P near the pair of feeding roller 40 without feeling much catching.

(4) Furthermore, when repulsive force equal to or greater than the predetermined force is transmitted to the torque limiter 55 provided in the load applying mechanism 52 from the load roller 53, the rotation in the reverse direction of the load roller 53 is allowed. For that reason, it is possible to pull the paper P while being fed to the pair of feeding roller 40 from the manual feeding path by force from a user.

In addition, the embodiment mentioned above may be changed as below.

In the embodiment, the torque limiter may have a configuration that regulates the rotation in the forward direction of the load roller 53 when force for rotating the load roller in the forward direction is less than a regulated value.

Figure 9:
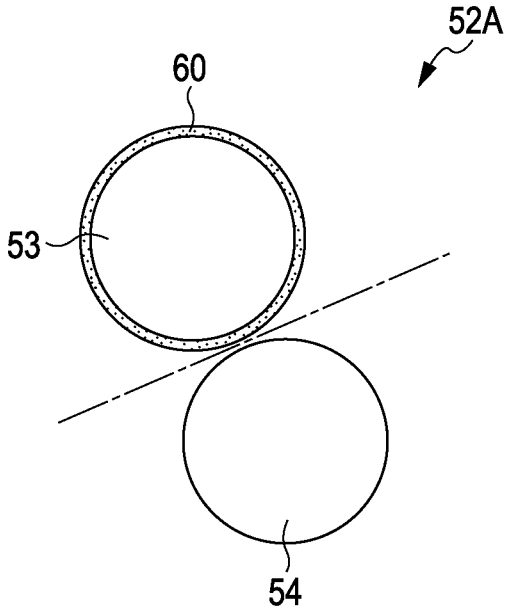
FIG. 9 is a schematic diagram that illustrates another embodiment of a load applying mechanism.

In the embodiment, as shown in FIG. 9, the load applying mechanism 52A may be provided with a ring member (an abutment member) 60 formed of cork, rubber or the like at an outer peripheral side of the load roller 53 in order to generate great frictional force between the load applying mechanism 52A and the paper P. In this case, the torque limiter 55 may be omitted.

In the embodiment, an abutment member formed of cork, rubber or the like may be provided instead of the load roller 53 and the roll roller 54. In this case, a biasing member for pushing the abutment member to the paper P that is fed along the manual feeding path may be provided.

Figure 10:
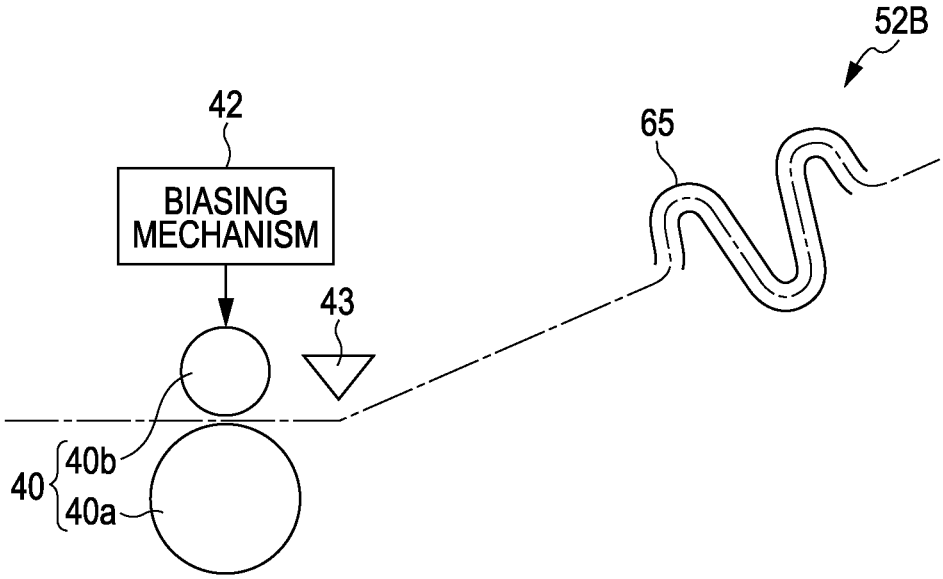
FIG. 10 is a schematic diagram that illustrates still another embodiment of the load applying mechanism.

In the embodiment, as shown in FIG. 10, at least a portion of the path of the upstream side in the feeding direction further than the pair of feeding roller 40 in the manual feeding path may be a meandering path that meanders to include a component of a direction perpendicular to the recorded surface of the paper P conveyed along the manual feeding path. In this case, the load applying mechanism 52B has a guidance portion 65 for guiding the medium along the meandering path, and the guidance portion 65 is preferably placed at a side that is opposite to the pair of feeding roller 40 with the bending permission space 36 interposed therebetween.

Even in this configuration, when the feeding rollers 40*a* and 40*b* are rotated in the reverse direction, the turning of the paper P itself to the upstream side in the feeding direction can be suppressed by the guidance portion 65. As a result, the paper P can be bent in the bending permission space 36, and thus the skew of the paper P can be cancelled.

In the embodiment, the recording apparatus may have a configuration that does not include the automatic feeding device 31. In this case, the manual feeding path may have a shape that is horizontally extended.

In the embodiment, the recording apparatus may have a configuration that does not include the image reading portion 14.

In the embodiment, the recording mechanism may be a so-called lateral scan type in which the scanning direction of the carriage 24 coincides with the feeding direction of the paper P. Furthermore, the recording mechanism may be a type that does not move the recording head 26 supported by the carriage 24 at the time of recording.

In the embodiment, the recording portion may be a so-called on-carriage type in which the ink cartridge 27 is not mounted on the carriage 24.

In the embodiment, the medium may be another medium (for example, a plastic film, cloth or a metal foil) other than the paper P if the medium can be bent.

In the embodiment, the recording mechanism may be a recording mechanism that includes a recording head of a wire impact type, a thermal transfer type, an electronograph type or the like.

In the embodiment mentioned above, the recording portion may be a fluid ejecting device that ejects or discharges other fluids other than ink, and various liquid ejecting devices that includes a liquid ejecting head or the like that discharges a small amount of liquid droplet. In addition, the liquid droplet refers to a liquid state that is discharged from the liquid ejecting apparatus, and also includes one leaving traces in a granular shape, a tear shape, and a filiform shape. Furthermore, liquid described herein may be a material capable of being ejected from the liquid ejecting apparatus. For example, the material may have a state when a substance is a liquid phase, and includes a liquid state having high or low viscosity, a flow regime like a liquid phase metal (a metallic melt), sol, gel water, other inorganic solvents, an organic solvent, a solution, and a liquid phase resin, liquid as one state of the substance, as well as material in which particles of a functional material formed of a solid body such as pigment and metallic particles are dissolved, dispersed or mixed in the solvent or the like. Furthermore, as a typical example of liquid, there is ink, liquid crystal, or the like described in the embodiment mentioned above. Herein, ink includes various liquid compositions such as a general water-based ink, an oil-based ink, a gel ink, and a hot-melt ink. As a specific example of the liquid ejecting apparatus, for example, it may be possible to adopt a liquid ejecting apparatus which ejects liquid including a material such as an electrode material and a color material that are used in manufacturing a liquid crystal display, an EL (electroluminescence) display, a surface emitting display, and a color filter in the form of dispersion or dissolution, a liquid ejecting apparatus which ejects a living body organic matter used in manufacturing a bio chip, a liquid ejecting apparatus which is used as a precision pipette and ejects liquid which becomes a sample, a printing device, a micro dispenser or the like. In addition, it may be possible to adopt a liquid ejecting apparatus which ejects lubricant oil by pinpoint to a precision machine such as a watch and a camera, a liquid ejecting apparatus which ejects transparent resin liquid such as an ultraviolet curing resin onto a substrate so as to form a micro hemispherical lens (an optical lens) or the like used in an optical communication element or the like, a liquid ejecting apparatus which ejects etching liquid such as acid or alkali so as to etch a substrate or the like. Furthermore, the fluid may be a particulate matter such as a toner. In addition, the fluid mentioned in the specification does not include one that consists of only a gas.

Next, a technical idea that can be understood by the embodiment mentioned above and other embodiments will be described as below.

(a) Recording apparatus that includes a control unit which controls the drive source, wherein the control unit rotates the pair of feeding roller in the reverse direction when the pair of feeding roller pinches the leading end of the medium that is fed from the upstream side in the feeding direction, and the control unit rotates the pair of feeding roller in the forward direction after the pinch of the leading end of the medium due to the pair of feeding roller is cancelled, and feeds the medium to the recording head side.

(b) The abutment member is a load roller that is freely rotated in the forward and reverse directions. The load applying unit further includes a regulation mechanism that gives force of permitting the rotation of the load roller in the forward direction when the load roller comes into contact with the medium which is fed to the downstream side in the feeding direction, and regulating the rotation in the reverse direction to the load roller when the load roller comes into contact with the medium returning to the upstream side in the feeding direction. The regulation mechanism permits the rotation of the load roller in the reverse direction when force given from the medium returning to the upstream side in the feeding direction to the load roller is equal to or greater than predetermined force.

According to the configuration mentioned above, when a user inserts the medium along the manual feeding path, it is possible to reduce load that is generated between the load applying unit (the load roller) and the medium. For that reason, a user is able to set the leading end of the medium near the pair of feeling roller without feeling a feel of catch too much.

Meanwhile, When the respective feeding rollers which pinch the leading end of the medium starts to rotate in the reverse direction, the rotation of the load roller in the reverse direction is regulated by the regulation mechanism. As a result, the load roller is able to give load for suppressing the movement to the upstream side in the feeding direction to the abutted portion of the medium. Thus, it is possible to bend the medium within the bending permission space, and thus, the skew of the medium can be cancelled.

In addition, in the regulation mechanism for applying the load to the abutted portion of the medium, when force given to the load roller from the medium returning to the upstream side in the feeding direction is equal to or greater than predetermined force, the rotation in the reverse direction of the load roller is allowed. For that reason, it is possible to pull the medium while being fed to the pair of feeding roller from the manual feeding path by force from a user.

The present application claim priority from Japanese Patent Application No. 2011-224595 filed on Oct. 12, 2011, and No. 2012-178143 filed on Aug. 10, 2012, which is hereby incorporated by reference in its entirety.

What is claimed is:

1. A recording apparatus comprising:

a recording head that performs recording on a medium which is fed along a manual feeding path;

a pair of feeding rollers that are rotated in a forward direction and a reverse direction by drive force from a drive source, and feed the medium to the recording head side along the manual feeding path by a rotation in the forward direction;

a load applying unit that is placed at an upstream side further than the pair of feeding rollers in a feeding direction of the medium along the manual feeding path, and gives load for suppressing the movement to the upstream side in the feeding direction with respect to the medium in which a leading end thereof returns to the upstream side in the feeding direction by the rotation of the pair of feeding rollers in the reverse direction; and an automatic feeding device that feeds the medium held in a medium holding portion up to the pair of feeding rollers along an automatic feeding path, wherein a bending permission space, which permits bending of the medium that is fed along the manual feeding path, is interposed between the pair of feeding rollers and the load applying unit in the feeding direction, wherein the automatic feeding device is provided with a conveying roller that is rotated by the drive force from the drive source, and the conveying roller is located at a side that is opposite to the pair of feeding rollers with the bending permission space interposed therebetween.

2. The recording apparatus according to claim 1, wherein the load applying unit has an abutment member that abuts with the medium that is fed along the manual feeding path.

3. The recording apparatus according to claim 1, wherein at least a portion of the path of the upstream side in the feeding direction further than the pair of feeding rollers in the manual feeding path is a meandering path that meanders to include a component of a direction perpendicular to a recording target surface of the medium that is conveyed along the manual feeding path, and the load applying unit has a guidance portion for guiding the medium along the meandering path.

4. The recording apparatus according to claim 1, where the conveying roller reverses and feeds the medium which is held in the medium holding portion.

5. The recording apparatus according to claim 1, wherein the conveying roller feeds the medium is switched back by the feeding rollers being rotated in a reverse direction after recording to one side of the medium.

6. A recording apparatus comprising:

a recording head that performs recording on a medium which is fed along a manual feeding path;

a pair of feeding rollers that are rotated in a forward direction and a reverse direction by drive force from a drive source, and feeds the medium to the recording head side along the manual feeding path by the rotation in the forward direction; and a load applying unit that is placed at an upstream side further than the pair of feeding rollers in a feeding direction of the medium along the manual feeding path, and gives load for suppressing the movement to the upstream side in the feeding direction with respect to a medium in which a leading end thereof abuts with the upstream side in the feeding direction of the pair of feeding rollers that is rotated in the reverse direction; and an automatic feeding device that feeds the medium held in the medium holding portion up to the pair of feeding rollers along an automatic feeding path, wherein a bending permission space, which permits bending of the medium that is fed along the manual feeding path, is interposed between the pair of feeding rollers and the load applying unit in the feeding direction, wherein the automatic feeding device is provided with a conveying roller that is rotated by drive force from the drive source, and the conveying roller is located at a side that is opposite to the pair of feeding rollers with the bending permission space interposed therebetween.

7. The recording apparatus according to claim 6, where the conveying roller reverses and feeds the medium which is held in the medium holding portion.

8. The recording apparatus according to claim 6, wherein the conveying roller feeds the medium is switched back by the feeding rollers being rotated in a reverse direction after recording to one side of the medium.

9. A recording apparatus comprising:

a recording head that performs recording on a first medium and a second medium which are fed along a manual feeding path;

a pair of feeding rollers that is rotated in a forward direction and a reverse direction by drive force from a drive source, and feeds the first medium and the second medium to the recording head side along the manual feeding path by the rotation in the forward direction;

a load applying unit that is placed at an upstream side further than the pair of feeding rollers in the feeding direction of the medium along the manual feeding path, and gives load for suppressing the movement to the upstream side in the feeding direction, with respect to the first medium which is pinched by the pair of feeding rollers rotating in the forward direction, a leading end of which is moved to a downstream side in the feeding direction, then is pinched by the pair of feeding rollers rotating in the reverse direction, and returns to the upstream side in the feeding direction, and the second medium, a leading end of which abuts with the upstream side in the feeding direction of the pair of feeding rollers rotating in the reverse direction; and an automatic feeding device that feeds the medium held in the medium holding portion up to the pair of feeding rollers along the automatic feeding path, wherein a bending permission space, which permits the bending of the first medium and the second medium that are fed along the manual feeding path, is interposed between the pair of feeding rollers and the load applying unit in the feeding direction, wherein the automatic feeding device is provided with a conveying roller that is rotated by the drive force from the drive source, and the conveying roller is located at a side that is opposite to the pair of feeding rollers with the bending permission space interposed therebetween.

10. The recording apparatus according to claim 9, wherein the conveying roller suppresses the movement to the upstream side in the feeding direction, by stopping the rotation, with respect to the first medium which is pinched by the pair of feeding rollers rotating in the forward direction, a leading end of which is moved to the downstream side in the feeding direction, then is pinched by the pair of feeding rollers rotating in the reverse direction, and returns to the upstream side in the feeding direction, and the second medium, a leading end of which abuts with the upstream side in the feeding direction of the pair of feeding rollers rotating in the reverse direction.

11. The recording apparatus according to claim 9, where the conveying roller reverses and feeds the medium which is held in the medium holding portion.

12. The recording apparatus according to claim 9, wherein the conveying roller feeds the medium is switched back by the feeding rollers being rotated in a reverse direction after recording to one side of the medium.

* * * * *